US010546704B2

(12) United States Patent
Delpozzo et al.

(10) Patent No.: US 10,546,704 B2
(45) Date of Patent: Jan. 28, 2020

(54) MEDIUM VOLTAGE POLE ASSEMBLY

(71) Applicant: ABB Schweiz AG, Baden (CH)

(72) Inventors: Andrea Delpozzo, Torbiato di Adro (IT); Emanuele Morelli, Linarolo (IT); Osvaldo Prestini, Nemboro (IT)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/994,096

(22) Filed: May 31, 2018

(65) Prior Publication Data

US 2018/0350538 A1 Dec. 6, 2018

(30) Foreign Application Priority Data

May 31, 2017 (EP) ..... 17173776

(51) Int. Cl.
*H01H 33/666* (2006.01)
*H01H 33/662* (2006.01)

(52) U.S. Cl.
CPC ... *H01H 33/666* (2013.01); *H01H 2033/6623* (2013.01)

(58) Field of Classification Search
CPC ..... H01H 33/666; H01H 33/66207; H01H 2033/6623; H01H 2033/6665; H01H 33/6662; H01H 9/0038; H01H 47/223; H01H 50/002; H02B 1/044; H02B 1/048
USPC ..... 218/120, 121, 134, 138, 139, 155, 118
See application file for complete search history.

(56) References Cited

U.S. PATENT DOCUMENTS 4,587,390 A * 5/1986 Gray ..... H01H 33/666 200/400
5,055,640 A * 10/1991 Lippi ..... H01H 33/666 218/120
6,130,594 A 10/2000 Morant et al.
6,198,062 B1 * 3/2001 Mather ..... H01H 33/022 218/120
6,396,018 B1 * 5/2002 Kinoshita ..... C10M 169/00 218/120
6,759,617 B2 * 7/2004 Yoon ..... H01H 33/666 218/120
8,629,366 B2 * 1/2014 Reuber ..... H01H 33/66207 218/44

(Continued)

OTHER PUBLICATIONS

European Patent Office, Extended Search Report issued in corresponding Application No. 17173776.0, dated Nov. 15, 2017, 7 pp.

*Primary Examiner* — Edwin A. Leon
*Assistant Examiner* — William A Bolton
(74) *Attorney, Agent, or Firm* — Taft Stettinius & Hollister LLP; J. Bruce Schelkopf

(57) ABSTRACT

A medium voltage pole assembly which includes a supporting frame, a pole insulator having a first and a second electrical terminal protruding therefrom, and a pole body housed within the pole insulator and having a first and a second electrical contact couplable and uncouplable with each other and respectively electrically connected to the first and second electrical terminal. The supporting frame includes first coupling means including a first coupling surface and the pole insulator includes second coupling means including one or more flaps slidingly couplable to the first coupling surface and mechanically fixing the pole insulator to the supporting frame.

20 Claims, 8 Drawing Sheets

(56) References Cited

U.S. PATENT DOCUMENTS

| | | | | |
|---|---|---|---|---|
| 8,642,912 | B2 * | 2/2014 | Lee | H01H 33/022 218/120 |
| 2002/0171531 | A1 | 11/2002 | Meckler et al. | |
| 2005/0063107 | A1 | 3/2005 | Benke | |
| 2010/0072045 | A1 * | 3/2010 | Freundt | H01H 33/666 200/293 |

* cited by examiner

MEDIUM VOLTAGE POLE ASSEMBLY

The present invention relates to a Medium Voltage pole assembly and to Medium Voltage switching devices comprising such pole assembly. For the purposes of the present invention, the term "switching devices" relates to circuit breaker, contactors and similar electric devices.

Medium voltage three-phase switching device, e.g. three phase contactors and circuit breakers, generally belong to two topological families for the fixation of the arc-quenching chamber to the insulating support and the main frame of the switching device.

In a first family, the switching device comprises one single mono-bloc for the three phases, while in a second family the switching device comprises three single-poles are fixed to the main frame by means of an appropriate number of screws (generally three or more) for each pole.

In the latter case, the fixation of the pole insulator to the main frame is traditionally obtained by means of bolted screws, screws in threaded holes or screws tightened into embedded co-molded bushings.

The traditional fixation between pole insulator and frame made using screw means requires a relatively large number of fasteners. As previously said, a minimum of three screws are normally required with the corresponding nuts, bolts co-molded bushes or threaded holes (depending on the kind of fixation) as well as a dedicated assembling step in the production line.

The combination of a relatively large amount of fasteners and a corresponding increased assembly time leads to a worsening of the production indexes, e.g. a worsening of the Design for Assembly Index (DFA-index) of the device.

Moreover, from a mechanical standpoint a screwed connection generally represents a highly stressed area during the operation involving a mechanical stress on the poles (mechanical endurance tests, short time current, vibrations, . . . ), thereby requiring a proper dimensioning in order to avoid cracks and failures in the plastic insulator.

Hence, the present disclosure is aimed at providing a Medium Voltage pole assembly and a Medium Voltage switching device comprising such pole assembly, which allow overcoming at least some of the above-mentioned shortcomings.

In particular, the present invention is aimed at providing a Medium Voltage pole assembly and a Medium Voltage switching device in which the number of fasteners (screws, washers, nuts, co-molded bushes, et similar) is reduced to a minimum.

Furthermore, the present invention is aimed at providing a Medium Voltage pole assembly and a Medium Voltage switching device in which the assembly time is reduced and the DFA index is improved.

Moreover, the present invention is aimed at providing a Medium Voltage pole assembly and a Medium Voltage switching device that can be manufactured in highly automated production lines. In addition, the present invention is aimed at providing a Medium Voltage pole assembly and a Medium Voltage switching device that can better withstand the mechanical stresses.

Also, the present invention is aimed at providing a Medium Voltage pole assembly and a Medium Voltage switching device in which the risk of cracks and failures in the plastic insulator is greatly reduced.

Thus, the present invention relates to a Medium Voltage pole assembly which is characterized in that it comprises a supporting frame, a pole insulator having a first and a second electrical terminal protruding therefrom, and a pole body housed within said pole insulator and having a first and a second electrical contact couplable and uncouplable with each other and respectively electrically connected to said first and a second electrical terminal. The Medium Voltage pole assembly is further characterized in that said supporting frame comprises first coupling means comprising a first coupling surface and said pole insulator comprises second coupling means comprising one or more flaps slidingly couplable to said first coupling surface and mechanically fixing said pole insulator to said supporting frame.

As better explained in the following description, thanks to the particular structure of the Medium Voltage pole assembly of the present invention the above-mentioned problems can be avoided. Indeed, the coupling means between the pole insulator and the supporting frame do not foresee as main joint components any screw means, but an innovative and unconventional fastening method, which is based on sliding surface joints.

In practice, as better explained in the following detailed description, in the Medium Voltage pole assembly according to the present invention the bottom of the pole insulator works as a cylindrical male side with one or more radial flaps, while the supporting frame works as female receptor of said flaps which can be inserted under the supporting frame and slidingly cooperate with the underneath surface thereof so as to mechanically fix and maintain in position said pole insulator on said supporting frame.

In order to avoid the backward sliding movement of the pole insulator with respect to the supporting frame one or more of the following mechanism can be foreseen: friction caused by the interference between the pole insulator flaps (and base surface) and the supporting frame surfaces, snap-fit joints between the pole insulator and the supporting frame, one or more fixing screw. In the latter case the mechanical stress on the fixation points, e.g. during opening and closing operations of the switching device, is withstood by the flap surfaces and not by the screw. The present invention also relates to a Medium Voltage switching device comprising a Medium Voltage pole assembly as described herein. For the purposes of the present invention, the term Medium Voltage switching device relates to a Medium Voltage circuit breaker, a Medium Voltage contactor and similar electric devices, e.g. a Medium Voltage three-phase vacuum contactor or circuit breaker.

Preferably, in an embodiment of the Medium Voltage pole assembly according to the present invention, said supporting frame can comprise third coupling means and said pole insulator can comprise fourth coupling means comprising a second coupling surface, said third coupling means comprising one or more tabs slidingly couplable with said second coupling surface of said pole insulator.

In a further embodiment of the Medium Voltage pole assembly according to the present invention, said supporting frame can comprise fifth coupling means and said pole insulator can comprise sixth coupling means comprising one or more coupling protrusion, said fifth coupling means comprising one or more holes for insertion of a one or more coupling protrusion of said pole insulator.

As previously said, a particular embodiment of the Medium Voltage pole assembly of the present invention comprises locking means, e.g. screw means, for locking said pole insulator to said supporting frame.

In practice, said pole insulator preferably comprises a base having a base lower surface which rests on said supporting frame when said pole insulator is coupled to said supporting frame.

Then said supporting frame preferably comprises a first horizontal plate having a frame upper surface and a frame lower surface, this latter forming said first coupling means. The one or more flaps forming said second coupling means protrudes from said base lower surface of said pole insulator and engages the frame lower surface when said pole insulator is coupled to said supporting frame.

In an embodiment of the Medium Voltage pole assembly according to the present invention the pole insulator is vertically insertable on said supporting frame and said one or more flaps are slidingly couplable to said first coupling surface by rotation around a vertical axis.

Preferably, said first plate of said supporting frame comprises one or more openings (slots) for vertical insertion of a corresponding one or more flaps of said pole insulator.

In practice, as previously said, the flaps of the pole insulator are inserted into the corresponding slots with a vertical movement; then the pole insulator is rotated so that the flaps slide underneath the horizontal plate of the supporting frame thereby allowing fixation of the pole insulator on the supporting frame.

Alternatively, the pole insulator can be vertically insertable on said supporting frame and in that said one or more flaps are slidingly couplable to said first coupling surface by linear translation on a horizontal plane.

In such embodiment, the flaps of the pole insulator are inserted into the corresponding slots with a vertical movement; then the pole insulator is linearly moved so that the flaps slide underneath the horizontal plate of the supporting frame thereby allowing fixation of the pole insulator on the supporting frame.

In other words, insertion of the pole insulator into the supporting plate is made with a first vertical movement (flaps inserted into the corresponding slots) and a second horizontal movement (sliding of the flaps under the plate of the supporting frame) that can be a rotation movement or a linear movement or a combination of the two.

In a particular embodiment of the Medium Voltage pole assembly according to the present invention that will be explained in more details hereinafter, said pole insulator can comprise a base having a base upper surface forming said second coupling surface, and said supporting frame can comprise a first plate having a frame upper surface and a frame lower surface, said one or more tabs protruding from said frame upper surface and being slidingly couplable with said base upper surface.

In a further particular embodiment of the Medium Voltage pole assembly according to the present invention, said supporting frame can comprise a first horizontal plate and a second vertical plate, said one or more holes for insertion of a corresponding one or more coupling protrusion of said pole insulator being positioned on said second vertical plate.

In an additional particular embodiment of the Medium Voltage pole assembly according to the present invention, said supporting frame comprises a first horizontal plate and a second vertical plate, said locking means for locking said pole insulator to said supporting frame comprising screw means, which are positioned on said second vertical plate.

Further features and advantages of the present invention will be more clear from the description of preferred but not exclusive embodiments of a Medium Voltage pole assembly and Medium Voltage switching device according to the invention, shown by way of examples in the accompanying drawings, wherein.

Figure 1:
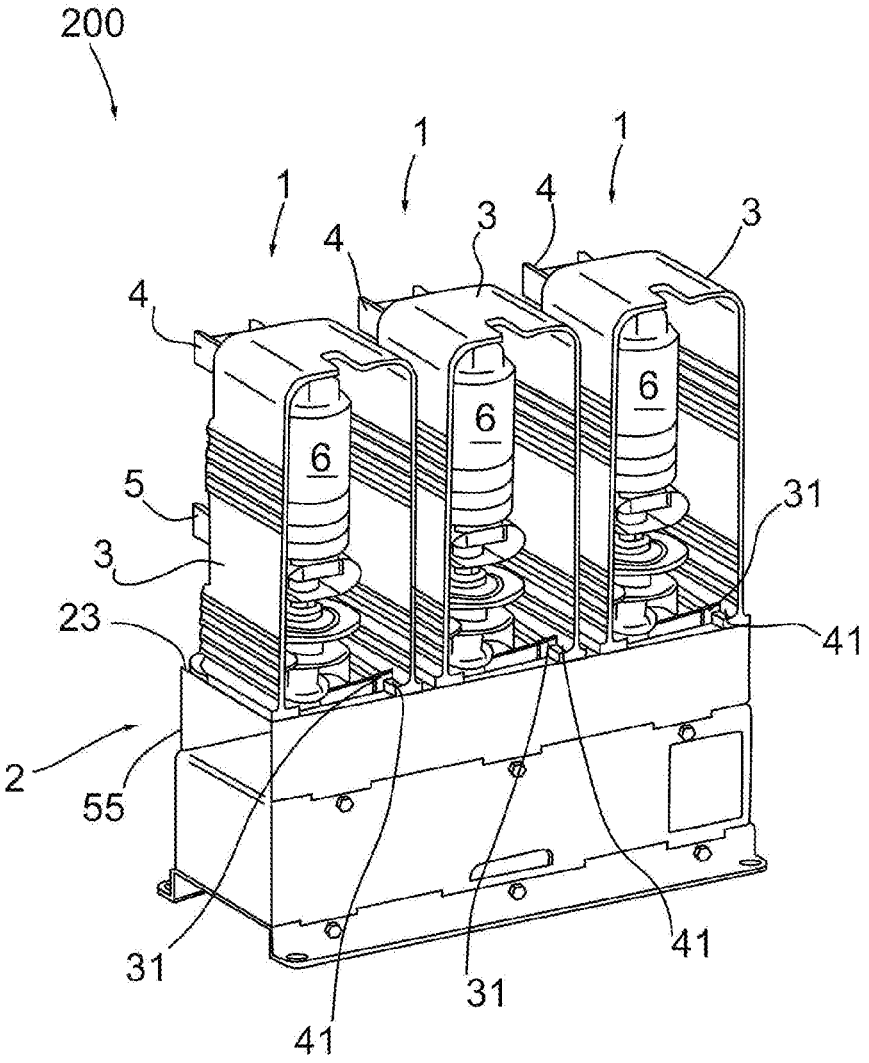
FIG. 1 is a perspective view of a first embodiment of a medium voltage switching device comprising a medium voltage pole assembly according to the invention.

With reference to the attached figures—in its more general definition—the Medium Voltage pole assembly 1, 100 of the present invention generally comprises a supporting frame 2, 102. The supporting frame generally houses an actuator and/or other apparatuses normally used in conventional medium voltage switching device. The actuator and such apparatuses can be of any type and will not be described in details.

The Medium Voltage pole assembly 1, 100 of the present invention further comprises a pole insulator 3, 103 having a first 4, 104 and a second 5, 105 electrical terminal protruding therefrom for the electrical connection of the switching device to the electrical plant.

A pole body 6 is housed within said pole insulator 3, 103 and generally has a first and a second electrical contact, which are couplable and uncouplable with each other and electrically connected respectively to said first 4, 104 and second electrical terminal 5, 105. The pole body 6 can be of any kind according to the needs and is normally provided with means for mechanical coupling with an actuator (not shown).

One of the distinguishing features of Medium Voltage pole assembly 1, 100 of the present invention is given by the supporting frame 2, 102 which comprises first coupling means 10, 110 comprising a first coupling surface 11, 111; at the same time the pole insulator 3, 103 comprises second coupling means 20, 120 comprising one or more flaps or extensions 21, 121 which are slidingly couplable to said first coupling surface 11, 111 so as to mechanically fix and maintain into position said pole insulator 3, 103 to said supporting frame 2, 102.

With reference to FIG. 1-4, in a first embodiment of the present invention, the pole insulator 3 comprises a base 32 having a base lower surface 33 which rests on the supporting frame 2 when the pole insulator 3 is coupled to the supporting frame 2. In turn, said supporting frame 2 conveniently comprises a first horizontal plate 22 which has a frame upper surface 23 and a frame lower surface 24.

On the pole insulator 3 said one or more flaps 21 protrudes from the base lower surface 33 of said pole insulator 3 and engages said frame lower surface 24 when said pole insulator 3 is coupled to said supporting frame 2.

Figure 2:
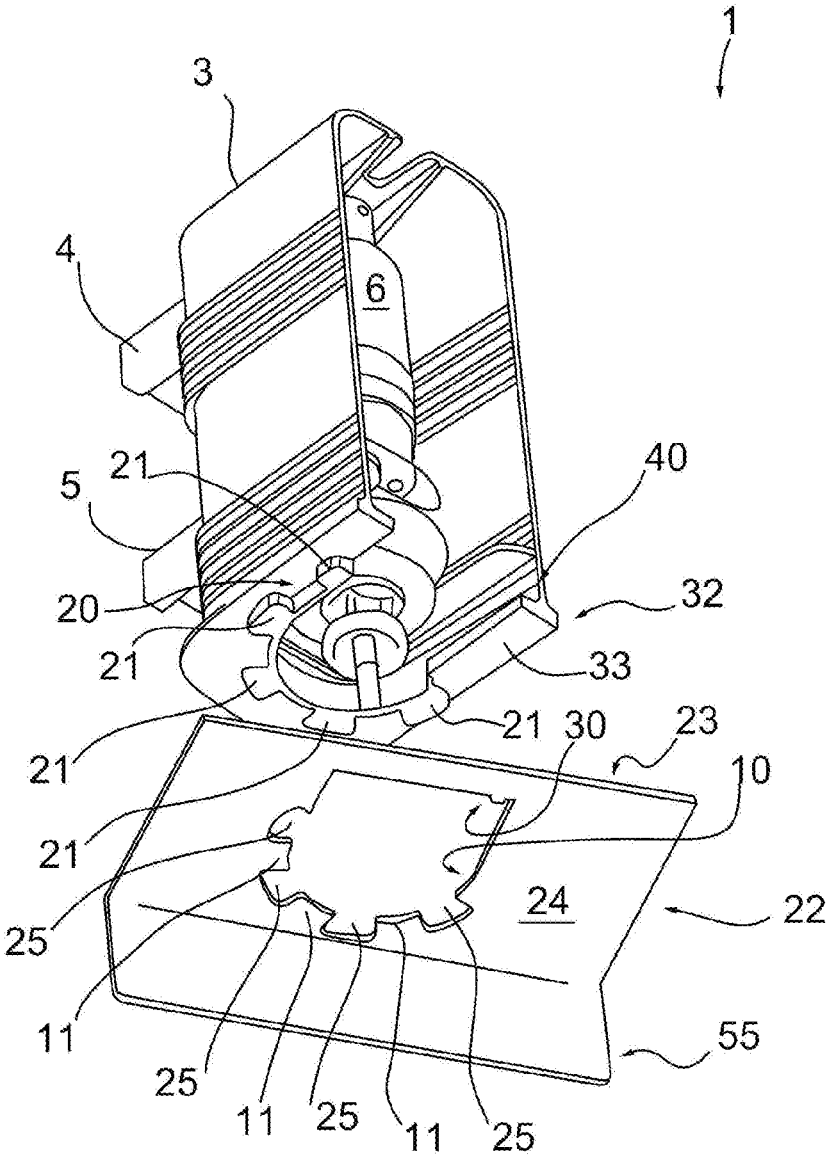
FIG. 2 is a first perspective view of a first embodiment of a medium voltage pole assembly according to the invention, during a first phase of the mounting operation.
Figure 3:
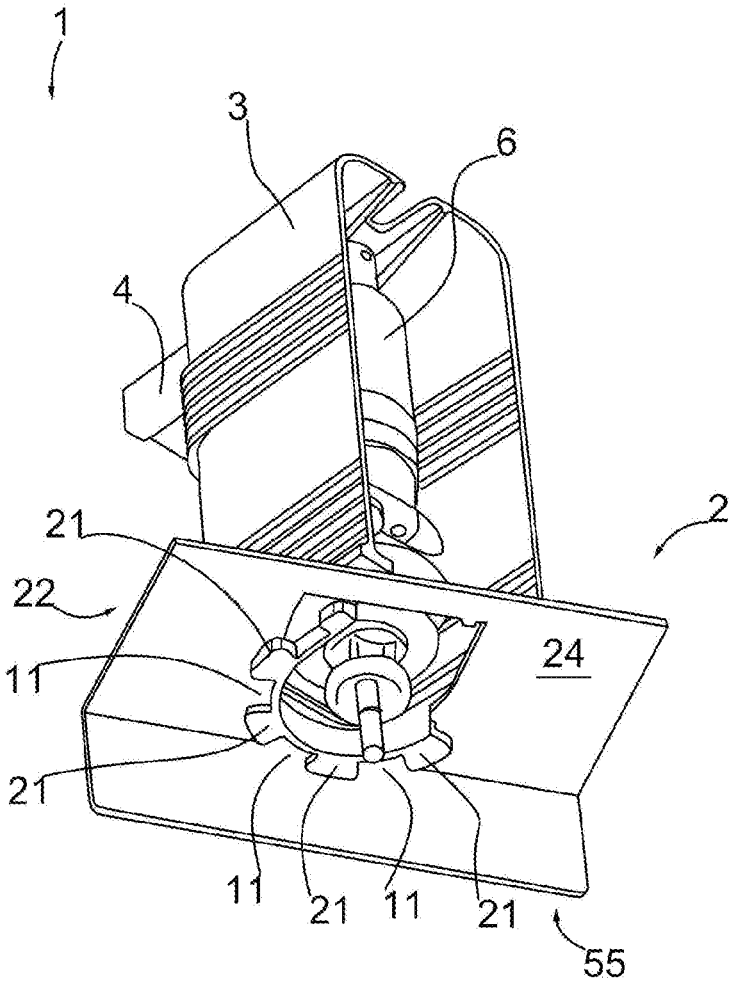
FIG. 3 is a second perspective view of a first embodiment of a medium voltage pole assembly according to the invention, during a second phase of the mounting operation.
Figure 4:
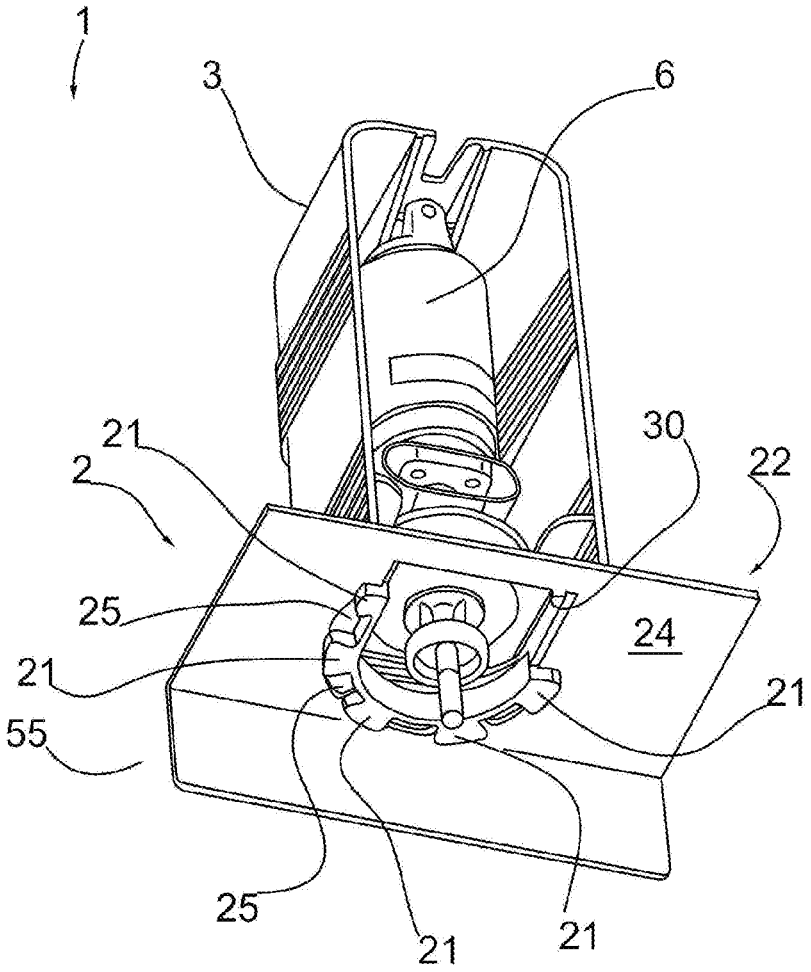
FIG. 4 is a third perspective view of a first embodiment of a medium voltage pole assembly according to the invention, during a third phase of the mounting operation.

As shown in the embodiment of the Medium Voltage pole assembly 1 of the present invention represented in FIGS. 2-4, the pole insulator 3 is vertically insertable on the supporting frame 2 by insertion of the flaps 21 into the openings (slot) 25 (see sequence of FIGS. 2 and 3).

Then, as shown in the sequence of FIGS. 3 and 4 the flaps 21 of the pole insulator 3 are coupled with the first coupling surface 11 of the supporting frame 2 by rotating the pole insulator 3 around a vertical axis.

Figure 5:
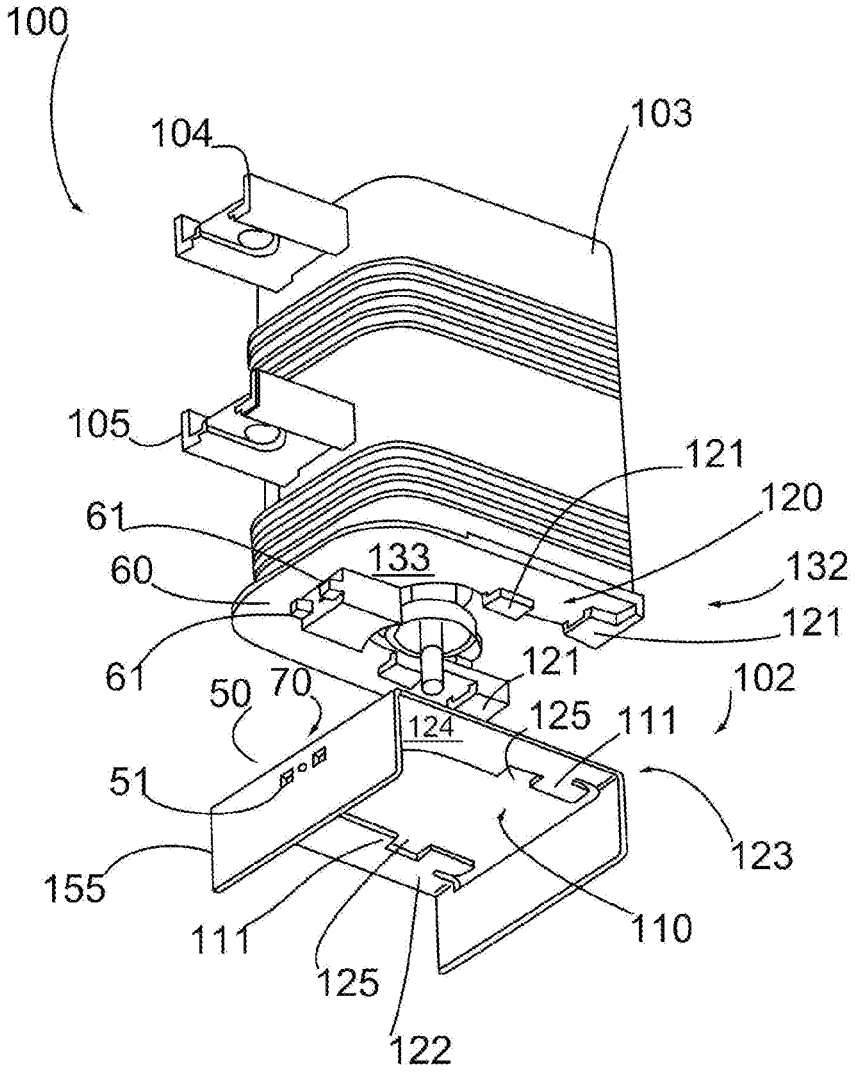
FIG. 5 is a first perspective view of a second embodiment of a medium voltage pole assembly according to the invention, during a first phase of the mounting operation.
Figure 6:
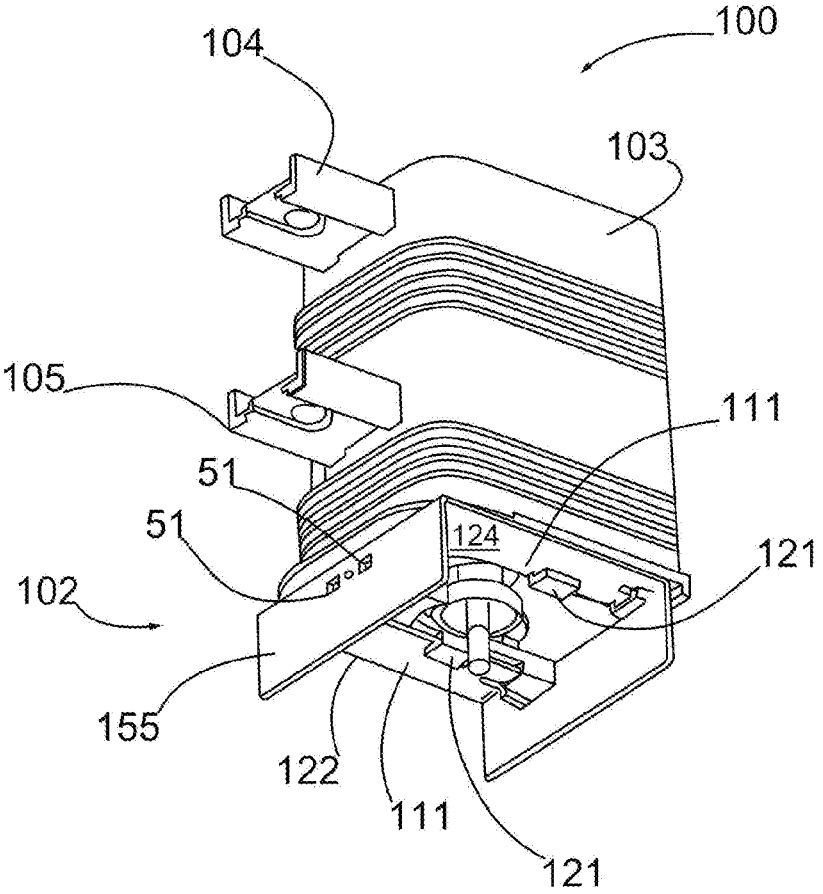
FIG. 6 is a second perspective view of a second embodiment of a medium voltage pole assembly according to the invention, during a second phase of the mounting operation.
Figure 7:
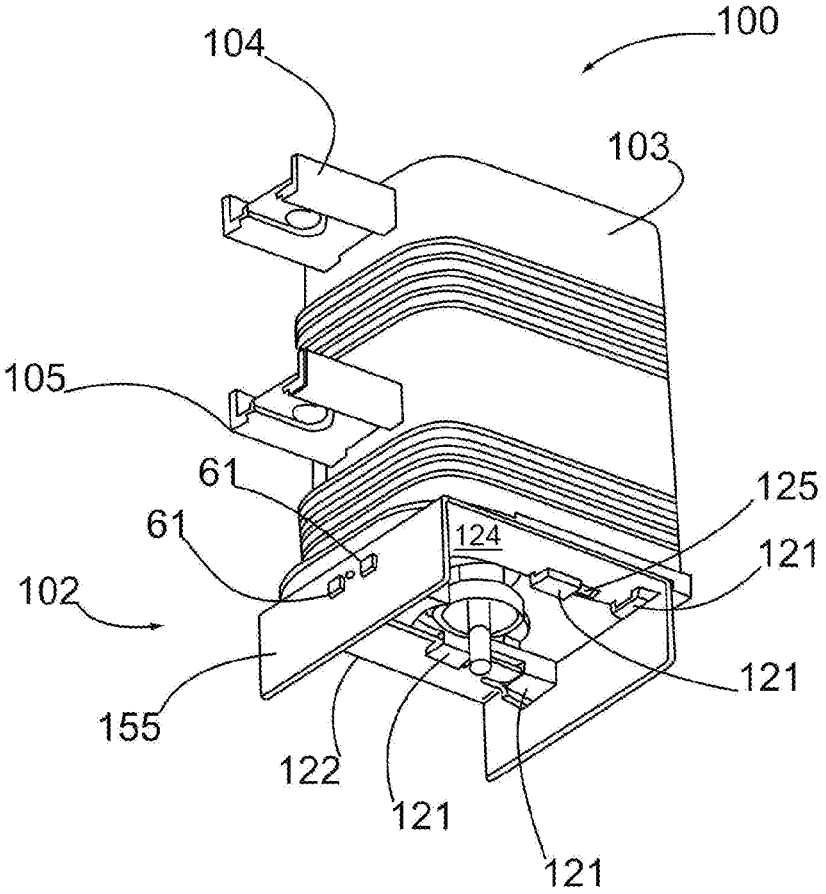
FIG. 7 is a third perspective view of a second embodiment of a medium voltage pole assembly according to the invention, during a third phase of the mounting operation.

Alternatively, as shown in a second embodiment of the present invention represented in FIGS. 5-7, the pole insulator 103 comprises a base 132 having a base lower surface 133 which rests on the supporting frame 102 when the pole insulator 103 is coupled to the supporting frame 102. In turn, said supporting frame 102 conveniently comprises a first horizontal plate 122 which has a frame upper surface 123 and a frame lower surface 124.

On the pole insulator 103 said one or more flaps 121 protrudes from the base lower surface 133 of said pole insulator 103 and engages said frame lower surface 124 when said pole insulator 103 is coupled to said supporting frame 102.

As shown in the embodiment of the Medium Voltage pole assembly 100 of the present invention represented in FIGS. 5-7, the pole insulator 103 is vertically insertable on the supporting frame 102 by insertion of the flaps 121 into the openings (slot) 125 (see sequence of FIGS. 5 and 6). Then, as shown in the sequence of FIGS. 6 and 7 the flaps 121 of the pole insulator 103 are coupled with the first coupling surface 111 of the supporting frame 102 by linear translation on a horizontal plane of the pole insulator 103.

With reference to FIGS. 1-4, in a particular embodiment of the Medium Voltage pole assembly 1 according to the invention said supporting frame 2 comprises third coupling means 30 comprising one or more tabs 31. In turn said pole insulator 3 comprises fourth coupling means 40 comprising a second coupling surface 41, said third coupling means 30 comprising one or more tabs 31 slidingly couplable with said second coupling surface 41 of said pole insulator 3.

More in particular, the pole insulator 3 comprises a base 32 having a base upper surface 41 forming said second coupling surface, while the supporting frame 2 comprises a first horizontal plate 22 having a frame upper surface 23 and a frame lower surface 24. With reference to FIGS. 1-4, and in particular to FIG. 1, the tabs 31 conveniently protrude from said frame upper surface 23 and are slidingly couplable with the base upper surface 41. In practice, during the rotation of the pole insulator 3 for fixing it onto the supporting frame 2, the flaps 21 engages the frame lower surface 24, while the tabs 31 engages the base upper surface 41.

With reference to FIGS. 5-7, in a further particular embodiment of the Medium Voltage pole assembly 1 according to the invention the supporting frame 102 comprises fifth coupling means 50 comprising one or more holes 51. At the same time, said pole insulator 103 comprises sixth coupling means 60 comprising one or more coupling protrusion 61 which are inserted in a corresponding hole 51 of said supporting frame 102.

More in particular, said supporting frame 102 comprises a first horizontal plate 122 and a second vertical plate 155, and said one or more holes 51 for insertion of a corresponding one or more coupling protrusion 61 of said pole insulator 103 are conveniently positioned on said second vertical plate 155.

In a further particular embodiment of the Medium Voltage pole assembly 1, 100 according to the present invention, the pole assembly 1, 100 also comprises locking means 70 for locking said pole insulator 3, 103 to said supporting frame 2, 102, and preventing any disengagement or relative movement of the pole insulator 3, 103 with respect to the supporting frame 2, 102.

Figure 8:
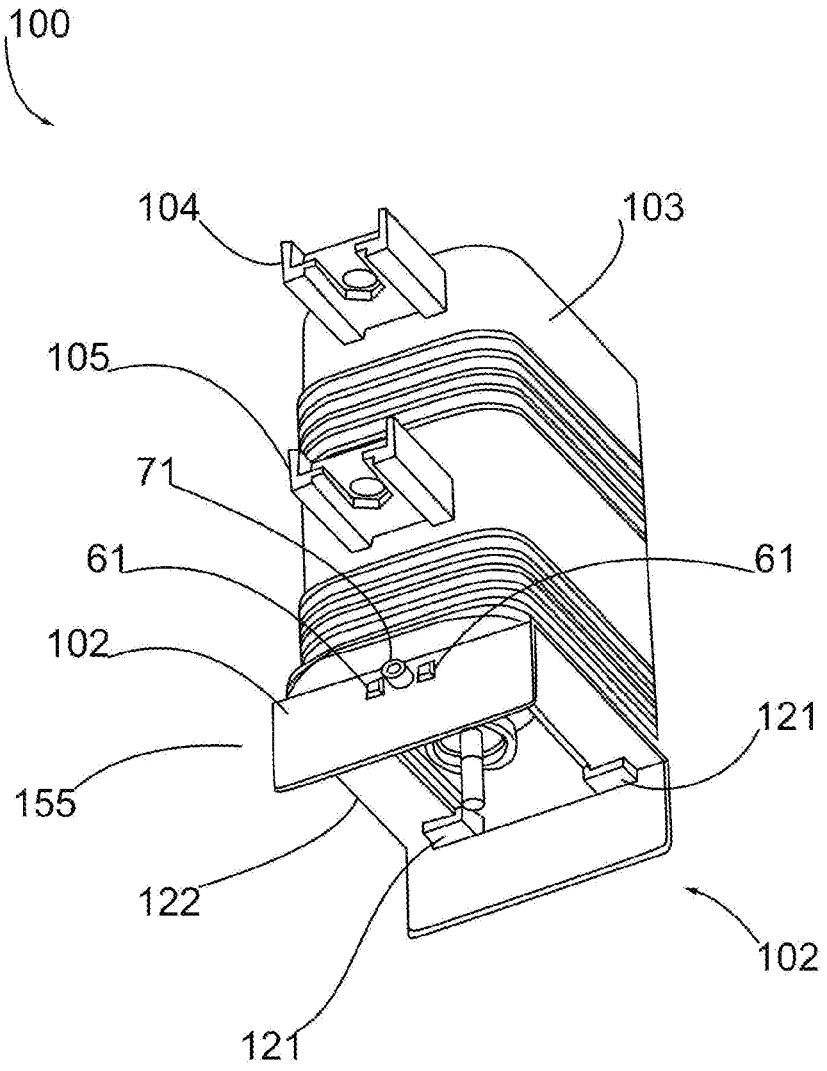
FIG. 8 is a fourth perspective view of a second embodiment of a medium voltage pole assembly according to the invention, during a fourth phase of the mounting operation.

In particular, as shown in FIG. 8, said supporting frame 102 conveniently comprises a first horizontal plate 122 and a second vertical plate 155. The locking means 70 for locking said pole insulator 103 to the supporting frame 102 comprises for instance screw means 71 which are positioned on said second vertical plate 155. Different locking means and different positioning thereof are also possible.

It is worth noting that even if screw means are present, their function is only to prevent disengagement or relative movement of the pole insulator 3, 103 with respect to the supporting frame 2, 102 and no mechanical stresses are generated in correspondence of the screw means. As previously explained, in the Medium Voltage pole assembly 1, 100 of the present invention the mechanical stresses in correspondence of the joining points are withstood by the interaction of the surfaces of the flaps 21, 121 of the pole insulator 3, 103 with the coupling surface 11, 111 on the supporting frame 2, 102.

A Medium Voltage switching device 200 comprising a Medium Voltage pole assembly 1, 100 as described herein is also part of the present invention.

Several variations can be made to the Medium Voltage pole assembly and Medium Voltage switching device thus conceived, all falling within the scope of the attached claims. In practice, the materials used and the contingent dimensions and shapes can be any, according to requirements and to the state of the art.

The invention claimed is:

1. A Medium Voltage pole assembly comprising a supporting frame, a pole insulator having a first and a second electrical terminal protruding therefrom, and a pole body housed within said pole insulator and having a first and a second electrical contact couplable and uncouplable with each other and respectively electrically connected to said first and second electrical terminal, wherein said supporting frame comprises a first coupling surface, and said pole insulator comprises one or more extensions slidingly couplable to said first coupling surface and mechanically fixing said pole insulator to said supporting frame.

2. The Medium Voltage pole assembly according to claim 1, wherein said pole insulator comprises a second coupling surface, and said supporting frame comprises one or more tabs slidingly couplable with said second coupling surface of said pole insulator.

3. The Medium Voltage pole assembly according to claim 2, wherein said pole insulator comprise a base having a base upper surface forming said second coupling surface, and in that said supporting frame comprises a first horizontal plate having a frame upper surface and a frame lower surface, said one or more tabs protruding from said frame upper surface and being slidingly couplable with said base upper surface.

4. The Medium Voltage pole assembly according to claim 2, wherein said pole insulator comprises one or more coupling protrusions, and said supporting frame comprises one or more holes for insertion of a corresponding one or more coupling protrusions of said pole insulator.

5. The Medium Voltage pole assembly according to claim 2, which further comprises a fastener for locking said pole insulator to said supporting frame.

6. The Medium Voltage pole assembly according to claim 2, wherein said pole insulator comprises a base having a base lower surface resting on said supporting frame when said pole insulator is coupled to said supporting frame.

7. The Medium Voltage pole assembly according to claim 1, wherein said pole insulator comprises one or more coupling protrusions, and said supporting frame comprises one or more holes for insertion of a corresponding one or more coupling protrusions of said pole insulator.

8. The Medium Voltage pole assembly according to claim 7, wherein said supporting frame comprises a first horizontal plate and a second vertical plate, said one or more holes for insertion of a corresponding one or more coupling protrusions of said pole insulator being positioned on said second vertical plate.

9. The Medium Voltage pole assembly according to claim 7, which further comprises a fastener for locking said pole insulator to said supporting frame.

10. The Medium Voltage pole assembly according to claim 7, wherein said pole insulator comprises a base having a base lower surface resting on said supporting frame when said pole insulator is coupled to said supporting frame.

11. The Medium Voltage pole assembly according to claim 1, which further comprises a fastener for locking said pole insulator to said supporting frame.

12. The Medium Voltage pole assembly according to claim 11, wherein said supporting frame comprises a first horizontal plate and a second vertical plate, said fastener for locking said pole insulator to said supporting frame comprising screw means positioned on said second vertical plate.

13. The Medium Voltage pole assembly according to claim 11, wherein said pole insulator comprises a base having a base lower surface resting on said supporting frame when said pole insulator is coupled to said supporting frame.

14. The Medium Voltage pole assembly according to claim 1, wherein said pole insulator comprises a base having a base lower surface resting on said supporting frame when said pole insulator is coupled to said supporting frame.

15. The Medium Voltage pole assembly according to claim 14, wherein said supporting frame comprises a first horizontal plate having a frame upper surface and a frame lower surface, said one or more extensions protruding from said base lower surface of said pole insulator and engaging said frame lower surface when said pole insulator is coupled to said supporting frame.

16. The Medium Voltage pole assembly according to claim 15, wherein said first horizontal plate of said supporting frame comprises one or more openings for vertical insertion of a corresponding one or more extensions of said pole insulator.

17. The Medium Voltage pole assembly according to claim 15, wherein said first horizontal plate of said supporting frame comprises one or more openings for vertical insertion of a corresponding one or more extensions of said pole insulator.

18. The Medium Voltage pole assembly claim 1, wherein the pole insulator is vertically insertable on said supporting frame, and in that said one or more extensions are slidingly couplable to said first coupling surface by rotation around a vertical axis.

19. The Medium Voltage pole assembly according to claim 1, wherein the pole insulator is vertically insertable on said supporting frame, and in that said one or more extensions are slidingly couplable to said first coupling surface by linear translation on a horizontal plane.

20. A Medium Voltage switching device comprising a Medium Voltage pole assembly according to claim 1.

* * * * *